United States Patent [19]

Imai

[11] Patent Number: 4,559,418

[45] Date of Patent: Dec. 17, 1985

[54] CERAMIC MICROPHONE

[75] Inventor: Nobuomi Imai, Tokyo, Japan

[73] Assignee: Primo Company Limited, Mitaka, Japan

[21] Appl. No.: 539,316

[22] Filed: Oct. 5, 1983

[30] Foreign Application Priority Data

Oct. 8, 1982 [JP] Japan ..... 57-152078

[51] Int. Cl.[4] ..... H04R 19/04

[52] U.S. Cl. ..... 179/111 E; 381/113

[58] Field of Search ..... 179/111 R, 111 E, 121 R, 179/131, 110 A, 113; 381/114; 310/322, 324, 365, 366

[56] References Cited

U.S. PATENT DOCUMENTS

| | | | |
|---|---|---|---|
| 3,127,481 | 3/1964 | Herve | 179/111 R |
| 3,158,762 | 11/1964 | Horan | 310/365 |
| 4,156,800 | 5/1979 | Sear | 310/322 |
| 4,268,912 | 5/1981 | Congdon | 310/365 |
| 4,376,302 | 3/1983 | Miller | 310/366 |
| 4,424,419 | 1/1984 | Chaput | 179/111 E |

FOREIGN PATENT DOCUMENTS

| | | | |
|---|---|---|---|
| 7502452 | 7/1976 | Netherlands | 179/110 A |
| 607297 | 4/1978 | U.S.S.R. | 310/322 |

*Primary Examiner*—Thomas W. Brown
*Assistant Examiner*—L. C. Schroeder
*Attorney, Agent, or Firm*—Cushman, Darby & Cushman

[57] ABSTRACT

A ceramic microphone is described which comprises a diaphragm for receiving sound waves, a thin ceramic plate attached to the diaphragm for transducing the sound waves to electric signals, and a plurality of electrodes on each of the opposite sides of the ceramic plate, the plurality of electrodes being polarized so that each of a pair of the electrodes faced across the ceramic plate forms a capacitor and the opposite-polarity electrodes of each of the capacitors are serially connected each other.

3 Claims, 9 Drawing Figures

CERAMIC MICROPHONE

FIELD OF THE INVENTION

This invention relates to a ceramic microphone and, in particular, to an improved microphone wherein a diaphragm is provided with a thin ceramic plate which has a plurality of thin metal polarized electrodes on each of the opposite sides thereof, each of a pair of the polarized electrodes faced across the ceramic plate forming a capacitor, so that the diaphragm is vibrated to generate voltage signals corresponding to sound pressures when the sound wave impinges on the diaphragm.

BACKGROUND OF THE INVENTION

There is well known a ceramic microphone wherein a pair of polarized electrodes are provided on the opposite sides of a thin ceramic plate (by, for example, annealing a thin silver plate on the surface of a ceramic plate having a thickness of 0.1 m/m at about 800° C.) and the ceramic plate is attached to a diaphragm which is vibrated by sound waves. The ceramic microphone utilizes a phenomenon generating voltage signals by vibrating the ceramic plate with the vibration of the diaphragm and stressing crystal grains in the ceramic plate.

In prior art, as shown in FIGS. 1 and 2, this type of a microphone is such that a thin metal positive (+) electrode 2 is provided on the front side of a ceramic plate 1 and a thin metal negative (−) electrode 3 on the rear side thereof, the positive electrode 2 is connected to a conductor 5, and the negative electrode 3 is attached to a metal diaphragm 4 in an electrically conductive manner and is connected to a conductor 6 through the diaphragm 4. In such a construction, the value of a capacitor formed between the electrodes 2 and 3, each of which is commonly used and has a diameter of 20–25 m/m, may reach the order of tens of thousands of picofarads.

The output of the microphone is connected to an FET (field effect transistor) circuit through the conductors 5 and 6 and is amplified thereby. The value of the capacitor for connecting it to the FET circuit without sacrificing the S/N ratio, the frequency characteristic, or the sensitivity of the order of tens of picofarads may be sufficient.

Although, in the conventional ceramic microphone, the capacitance between electrodes represents the order of tens of thousands of picofarads, the electrical energy produced is hardly utilized.

SUMMARY OF THE INVENTION

The present invention has been accomplished by noticing that, by providing n-divided electrodes (where n is an integral number more than 2) on a ceramic plate in place of each of a pair of conventional electrodes as shown in FIGS. 1 and 2, polarizing the respective n-divided electrodes in an alternating opposite-polarity pattern so that each of a pair of the electrodes faced across the ceramic plate form a capacitor, and serially connecting the opposite-polarity electrodes of each of the capacitors to each other. This has the effect of multiplying the input voltage to an FET amplifying circuit by a factor of n.

It is an object of the present invention to provide a ceramic microphone wherein the value of capacitance between polarized electrodes is effectively reduced, thereby enhancing the sensitivity of the microphone.

This and other objects and advantages of the present invention will appear more clearly from the following detailed disclosure read in conjunction with the accompanying drawings.

DESCRIPTION OF THE PREFERRED EMBODIMENTS

Figure 1:
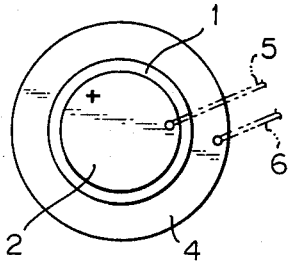
Fig. 1 PRIOR ART
FIG. 1 shows a plane view of the transducer portion of a ceramic microphone in prior art.
Figure 2:
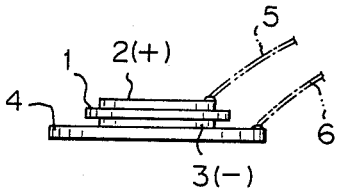
Fig. 2 PRIOR ART
FIG. 2 shows a side view of the transducer portion shown in FIG. 1, the thickness of which is emphasized.

FIGS. 3 through 6 show a preferred embodiment of the present invention in which, for the sake of convenience, there are provided four-divided electrodes.

As shown, fan-shaped polarized electrodes 2*a*, 2*b*, 2*c* and 2*d* are provided on the front side of a ceramic plate 1 and fan-shaped polarized electrodes 3*a*, 3*b*, 3*c* and 3*d* on the rear side thereof; the electrodes 2*a* and 2*b* are connected by a conductor 7, the electrodes 2*c* and 2*d* by a conductor 8 and the electrodes 3*b* and 3*c* by a conductor 9; and terminals 10 and 11 are connected to the electrodes 3*a* and 3*d*, respectively. The ceramic plate 1 with the electrodes, the conductors, and the terminals on the opposite sides thereof is attached to a diaphragm 4 made of synthetic resin. An aluminum plate which is electrically insulated by alumilite treatment, may be utilized in placed of diaphragm 4 and conductors used as the terminals may be directly soldered thereto.

Figure 3:
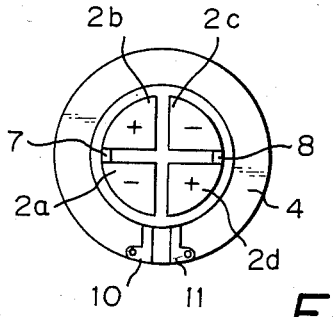
FIG. 3 shows a plane view of the transducer portion of a ceramic microphone in accordance with the present invention.
Figure 4:
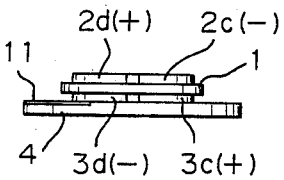
FIG. 4 shows a side view of the transducer portion shown in FIG. 3, the thickness of which is emphasized.
Figure 5:
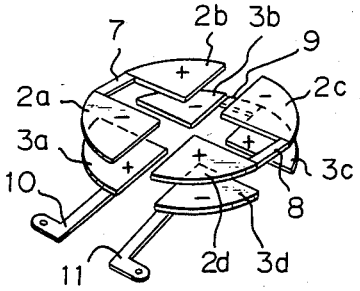
FIG. 5 is a perspective view showing the arrangement of the electrodes in accordance with the present invention.
Figure 6:
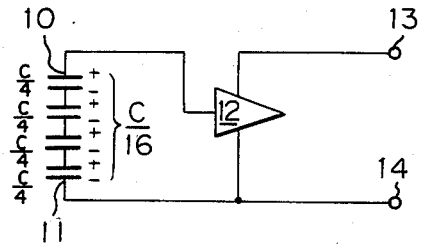
FIG. 6 shows a circuit diagram of the microphone in accordance with the present invention.

Assuming that the area of the conventional electrode 2 in FIG. 1, which forms the capacitor having the value of capacitance, C, with the electrode 3, is equal to the overall areas of the electrodes 2*a* through 2*d* of the present invention, as shown in FIGS. 3 to 5, and each of the electrodes 2*a* through 2*d* has the same area, the value of the capacitor formed by, for example, 2*a* and 3*a* is C/4 and, therefore, the value of a system in which each of the capacitors is connected in series is C/16. When the diaphragm 4 receives sound waves, and the output of the serially-connected capacitors is applied from the terminals 10 and 11 to an FET circuit 12, an electrically-converted acoustic output can be obtained.

Figure 7:
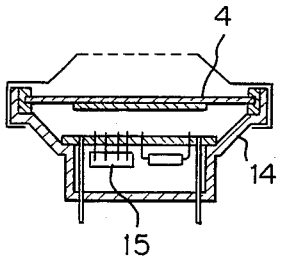
FIG. 7 shows a sectional view of the microphone including the transducer shown in FIGS. 3 to 5.
Figure 8:
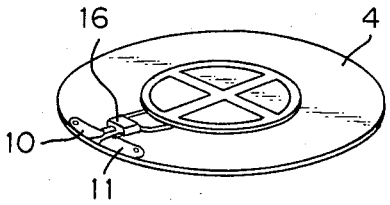
FIG. 8 shows a perspective view of the transducer portion in accordance with the present invention, which has an FET circuit and output terminals on the diaphragm.

FIGS. 7 and 8 illustrate microphones in which the diaphragm 4 having such n-divided electrodes and an amplifier are incorporated.

FIG. 7 illustrates one preferred embodiment in which the diaphragm 4 having the divided electrodes is attached to the front portion of a casing 14 having a sound conducting hole and an amplifier 15 is incorporated in the rear portion of the casing.

FIG. 8 illustrates another preferred embodiment in which a simple anplifier 16 in the form of an integrated circuit including an FET is attached to the edge of the diaphragm 4. This diaphragm is included in the casing to construct a complete microphone, as shown in FIG. 7.

As described above, according to the present invention, the ceramic microphone is constructed so that the n-divided electrodes, in place of the single conventional electrode, are provided on the ceramic plate. Accordingly, the following effects can be accomplished;

(1) Since the resultant capacitance of the present invention becomes $C/n^2$, provided that the value of the conventional capacitor is C, and the FET circuit merely requires about 10 pF of the input capacitance thereto, it is possible to increase the output of the microphone and enhance its sensitivity until the value of $C/n^2$ reaches about 10 pF.

(2) As the result of carrying out the present invention, if $n=100$, the increase in sensitivity was 40 dB without changing the current consumed in the FET circuit. The number of division was substantially limited to $n=100$.

Figure 9:
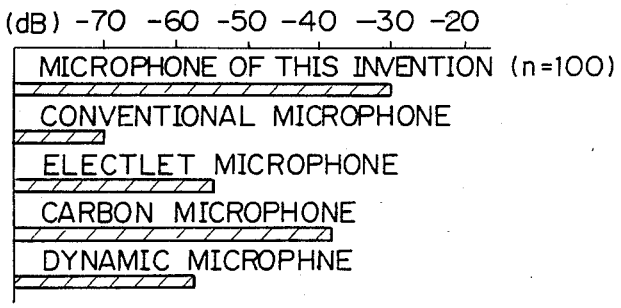
FIG. 9 is a diagram showing the characteristics of sensitivity of many kinds of microphones.

FIG. 9 shows the output sensitivity of many kinds of microphones. A carbon microphone has the best sensitivity in prior art, but it has a disadvantage that it requires a large current.

(3) Since the sensitivity is increased and the FET circuit can be efficiently used, it is possible to provide a small-sized and high sensitivity microphone.

What is claimed is:

1. A ceramic microphone comprising;

a diaphragm for receiving sound waves;

a thin ceramic plate attached to said diaphragm for transducing said sound waves to electric signals;

electrode means for taking out the transduced electric signals, said electrode means comprising a plurality of electrodes on each of the opposite sides of said ceramic plate, said plurality of electrodes being polarized so that each of a pair of said electrodes faced across said ceramic plate forms a capacitor and the opposite-polarity electrodes of each of said capacitors are serially connected to each other; and a FET amplifying circuit connected to said electrode means an in a casing of the microphone.

2. The ceramic microphone of claim 1 wherein said FET amplifying circuit is in the form of an integrated circuit and is attached to the edge of said diaphragm.

3. A ceramic microphone comprising:

diaphragm means for receiving sound waves;

ceramic plate means attached to said diaphragm means for transducing said sound waves;

electrode means for converting said transduced sound waves to electrical signals, comprising:

(a) a plurality of sub-electrodes of identical size, shape and area;

(b) each said sub-electrodes attached to said ceramic plate means in such a way that the majority of the surface area of said sub-electrode is overlapping another sub-electrode on the reverse side of said ceramic plate to form an electrode capacitor, said another sub-electrode being of opposite polarity to said each sub-electrode;

(c) said each sub-electrode also being of opposite polarity to adjacent sub-electrodes on the same side of said ceramic plate;

internal FET amplification means for amplifying said electrical signals from said electrode means, said FET amplifying circuit being an integrated circuit attached to said diaphragm means; and terminal means for serially connecting said electrode capacitors to said FET amplification means, said terminal means connecting each said sub-electrode to one of an adjacent sub-electrode and said FET amplification means.

* * * * *